US008571227B2

(12) United States Patent
Donaldson et al.

(10) Patent No.: US 8,571,227 B2
(45) Date of Patent: Oct. 29, 2013

(54) NOISE CANCELLATION EARPHONE

(75) Inventors: Mark Donaldson, Rue St. Germain (CH); Damien Oliver Givernet, Saint-Genis-Pouilly (FR)

(73) Assignee: Phitek Systems Limited, Auckland (NZ)

( * ) Notice: Subject to any disclaimer, the term of this patent is extended or adjusted under 35 U.S.C. 154(b) by 773 days.

(21) Appl. No.: 12/084,863

(22) PCT Filed: Nov. 13, 2006

(86) PCT No.: PCT/IB2006/003179

§ 371 (c)(1),
(2), (4) Date: Feb. 25, 2010

(87) PCT Pub. No.: WO2007/054807

PCT Pub. Date: May 18, 2007

(65) Prior Publication Data

US 2010/0142726 A1 Jun. 10, 2010

(30) Foreign Application Priority Data

Nov. 11, 2005 (NZ) ..... 543567
Feb. 9, 2006 (NZ) ..... 545244

(51) Int. Cl.
*G10K 11/16* (2006.01)

(52) U.S. Cl.
USPC ..... 381/71.6; 381/71.1; 381/96

(58) Field of Classification Search
USPC ..... 381/309–310, 71.6, 367, 376, 380, 74, 381/370–371, 381–382, 71.1, 96
See application file for complete search history.

(56) References Cited

U.S. PATENT DOCUMENTS

| | | | |
|---|---|---|---|
| 1,368,307 | A | 2/1921 | Waldron |
| 1,498,727 | A | 6/1924 | Haskel |
| 1,514,152 | A | 11/1924 | Gernsback |
| 1,586,140 | A | 5/1926 | Bonnette |
| 1,807,225 | A | 5/1931 | Pack |
| 2,346,395 | A | 4/1944 | Rettinger |
| 2,379,891 | A | 7/1945 | Eckardt |
| 2,427,844 | A | 9/1947 | Eklov |
| 2,490,466 | A | 12/1949 | Olson |
| 2,603,724 | A | 7/1952 | Kettler |
| 2,622,159 | A | 12/1952 | Herman |
| 2,714,134 | A | 7/1955 | Touger |
| 2,761,912 | A | 9/1956 | Touger |
| 2,775,309 | A | 12/1956 | Vilichur |
| 2,848,560 | A | 8/1958 | Wiegand |
| 2,972,018 | A | 2/1961 | Hawley et al. |

(Continued)

FOREIGN PATENT DOCUMENTS

| | | |
|---|---|---|
| CN | 1101203 | 4/1995 |
| CN | 1213626 | 4/1999 |

(Continued)

*Primary Examiner* — Disler Paul
(74) *Attorney, Agent, or Firm* — Jackson Walker, LLP

(57) ABSTRACT

An active noise cancellation earphone (1) has an acoustic path including a cavity (36) and a pipe (20) leading to the auditory canal (40) which are arranged to form an oscillator in use which has the effect of recovering the open loop system phase characteristics at a selected frequency or frequency range. The earphone (1) also has two parts (5,18) which can be adjusted relative to each other to allow the earphone (1) to be comfortably and correctly positioned in use.

18 Claims, 5 Drawing Sheets

(56) References Cited

U.S. PATENT DOCUMENTS

Figure 1:
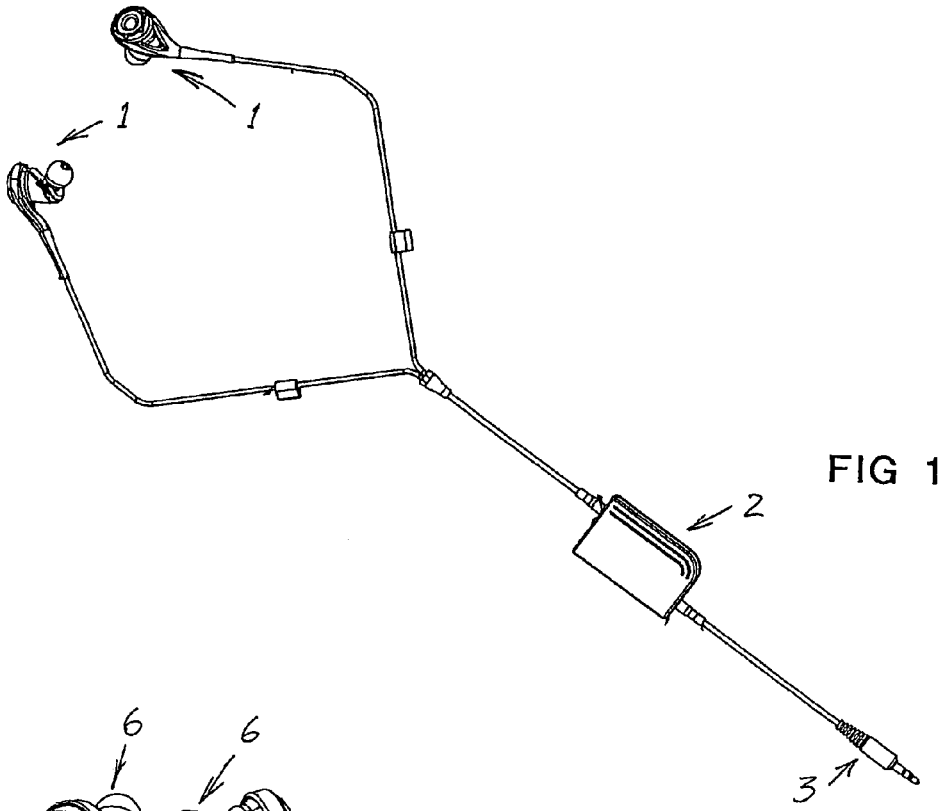

| | | | | |
|---|---|---|---|---|
| 2,989,598 | A | 8/1961 | Touger | |
| 3,073,411 | A | 1/1963 | Bleazey | |
| 3,112,005 | A | 11/1963 | Shaw | |
| RE26,030 | E | 5/1966 | Marchand | |
| 3,367,040 | A | 2/1968 | Vani | |
| 3,403,235 | A | 9/1968 | Bishop | |
| 3,532,837 | A | 10/1970 | Dyer | |
| 3,602,329 | A | 8/1971 | Bauer et al. | |
| 3,644,939 | A | 2/1972 | Beguin | |
| 3,727,004 | A | 4/1973 | Bose | |
| 3,766,332 | A | 10/1973 | Carlson | |
| 3,927,262 | A | 12/1975 | Goeckel | |
| 3,997,739 | A | 12/1976 | Kishikawa | |
| 4,005,267 | A | 1/1977 | Gorike | |
| 4,005,278 | A | 1/1977 | Gorike | |
| 4,006,318 | A | 2/1977 | Sebesta | |
| 4,027,117 | A | 5/1977 | Nakamura | |
| 4,041,256 | A | 8/1977 | Ohta | |
| 4,058,688 | A | 11/1977 | Nishimura | |
| 4,156,118 | A | 5/1979 | Hargrave | |
| 4,158,753 | A | 6/1979 | Gorike | |
| 4,211,898 | A | 7/1980 | Atoji et al. | |
| 4,297,537 | A | 10/1981 | Babb | |
| 4,311,206 | A | 1/1982 | Johnson | |
| 4,338,489 | A | 7/1982 | Gorike | |
| 4,347,405 | A | 8/1982 | Davis | |
| 4,399,334 | A | 8/1983 | Kakiuchi | |
| 4,403,120 | A | 9/1983 | Yoshimi | |
| 4,418,248 | A | 11/1983 | Mathis | |
| 4,441,576 | A | 4/1984 | Allen | |
| 4,455,675 | A | 6/1984 | Bose | |
| 4,494,074 | A | 1/1985 | Bose | |
| 4,527,282 | A | 7/1985 | Chaplin et al. | |
| 4,528,689 | A | 7/1985 | Katz | |
| 4,529,058 | A | 7/1985 | Emery | |
| 4,572,324 | A | 2/1986 | Fidi et al. | |
| 4,581,496 | A | 4/1986 | Sweany | |
| 4,592,366 | A | 6/1986 | Sainomoto | |
| 4,644,581 | A | 2/1987 | Sapiejewski | |
| 4,646,872 | A | 3/1987 | Kamon | |
| 4,669,129 | A | 6/1987 | Chance | |
| 4,670,733 | A | 6/1987 | Bell | |
| 4,742,887 | A | 5/1988 | Yamagishi | |
| 4,809,811 | A | 3/1989 | Gorike | |
| 4,847,908 | A | 7/1989 | Nieuwendijk | |
| 4,852,177 | A | 7/1989 | Ambrose | |
| 4,893,695 | A | 1/1990 | Tamura et al. | |
| 4,905,322 | A | 3/1990 | Aileo et al. | |
| 4,922,542 | A | 5/1990 | Sapiejewski | |
| 4,949,806 | A | 8/1990 | Hofer | |
| 4,985,925 | A | 1/1991 | Langberg et al. | |
| 4,989,271 | A | 2/1991 | Sapiejewski | |
| 5,001,763 | A | 3/1991 | Moseley | |
| 5,020,163 | A | 6/1991 | Aileo et al. | |
| 5,117,461 | A | 5/1992 | Moseley | |
| 5,134,659 | A | 7/1992 | Moseley | |
| 5,181,252 | A | 1/1993 | Sapiejewski | |
| 5,182,774 | A | 1/1993 | Bourk | |
| 5,208,868 | A | 5/1993 | Sapiejewski | |
| 5,267,321 | A | 11/1993 | Langberg | |
| 5,305,387 | A | 4/1994 | Sapiejewski | |
| 5,333,622 | A | 8/1994 | Casali et al. | |
| 5,343,523 | A | 8/1994 | Bartlett et al. | |
| 5,497,426 | A | 3/1996 | Jay | |
| 5,504,281 | A | 4/1996 | Whitney | |
| 5,652,799 | A | 7/1997 | Ross et al. | |
| 5,675,658 | A | 10/1997 | Brittain | |
| 5,740,257 | A | 4/1998 | Marcus | |
| 5,913,178 | A | 6/1999 | Olsson | |
| 5,937,070 | A | 8/1999 | Todter et al. | |
| 5,970,160 | A | 10/1999 | Nilsson et al. | |
| 6,061,456 | A | 5/2000 | Andrea et al. | |
| 6,084,976 | A * | 7/2000 | Lin | 381/380 |
| 6,163,615 | A | 12/2000 | Callahan | |
| 6,278,786 | B1 | 8/2001 | McIntosh | |
| 6,532,296 | B1 * | 3/2003 | Vaudrey et al. | 381/371 |
| 6,597,792 | B1 | 7/2003 | Sapiejewski | |
| 6,831,984 | B2 | 12/2004 | Sapiejewski | |
| 7,103,188 | B1 | 9/2006 | Jones | |
| 7,248,705 | B1 | 7/2007 | Mishan | |
| 7,289,636 | B2 * | 10/2007 | Saunders et al. | 381/72 |
| 7,616,772 | B2 * | 11/2009 | Sabick et al. | 381/374 |
| 2002/0015501 | A1 | 2/2002 | Sapiejewski | |
| 2004/0017919 | A1 * | 1/2004 | Miyakura | 381/71.6 |
| 2006/0067555 | A1 * | 3/2006 | Tsai | 381/380 |
| 2006/0098836 | A1 * | 5/2006 | Sabick et al. | 381/380 |
| 2008/0159554 | A1 * | 7/2008 | Sung et al. | 381/71.6 |

FOREIGN PATENT DOCUMENTS

| | | | |
|---|---|---|---|
| DE | 3512405 | A1 | 10/1985 |
| DE | 8703084 | | 11/1987 |
| EP | 0195641 | B1 | 9/1986 |
| EP | 0582404 | | 2/1994 |
| EP | 0582404 | A3 | 2/1994 |
| EP | 0414479 | | 9/1995 |
| EP | 0688143 | | 12/1995 |
| EP | 0873040 | | 10/1998 |
| EP | 0688143 | B1 | 8/2001 |
| FR | 2595178 | A1 | 9/1987 |
| GB | 1379372 | | 1/1975 |
| GB | 2000941 | | 1/1979 |
| GB | 2168220 | A | 6/1986 |
| GB | 2172470 | A | 9/1986 |
| GB | 2187361 | A | 9/1987 |
| GB | 2188210 | A | 9/1987 |
| GB | 3706481 | C2 | 9/1987 |
| GB | 2234882 | | 2/1991 |
| GB | 2234882 | A | 2/1991 |
| JP | 04227396 | A | 8/1992 |
| NL | 8101815 | | 11/1981 |
| WO | WO91/13429 | | 9/1991 |
| WO | WO 95/00946 | | 1/1995 |
| WO | WO 95/08907 | | 3/1995 |
| WO | WO 98/41974 | | 9/1998 |
| WO | WO 02/084982 | A2 | 10/2002 |

* cited by examiner

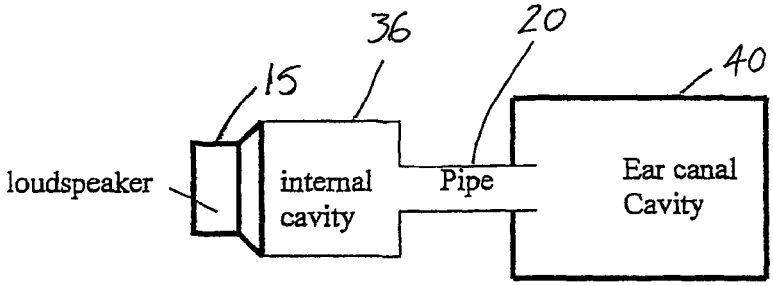
FIG 7A
FIG 7B
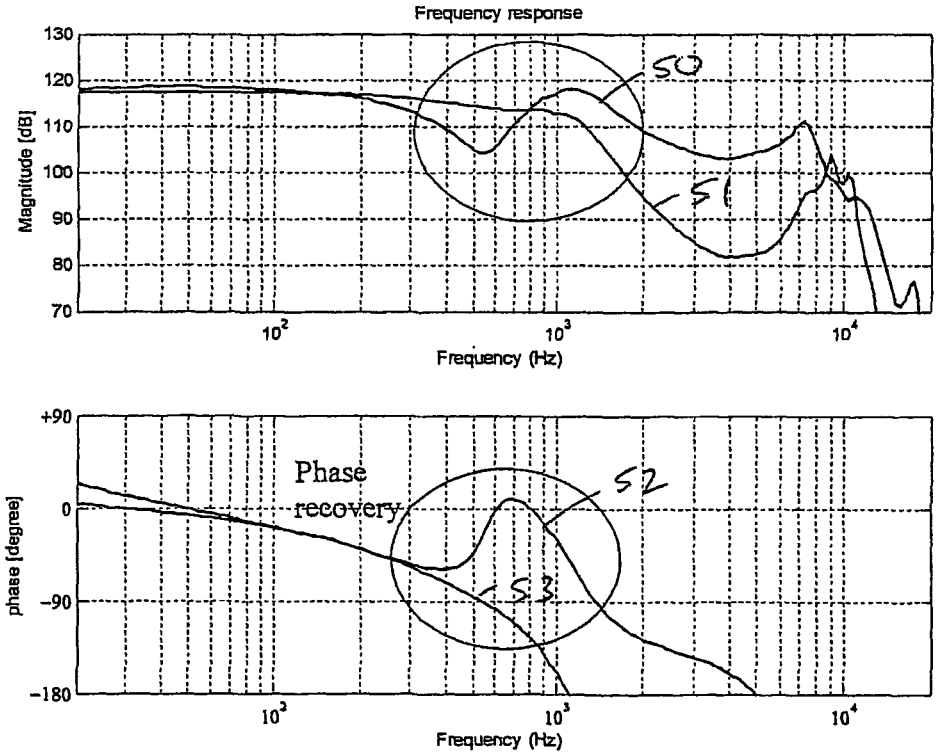
FIG 7C

NOISE CANCELLATION EARPHONE

FIELD OF INVENTION

This invention relates to earphones and has particular application to earphone apparatus having a sound transducer adapted for location directly in or adjacent to the human auditory canal. The invention also relates to noise cancellation systems and has application to an ear phone assembly for use in conjunction with, or as part of, a noise cancellation system

BACKGROUND

Noise cancellation headphones provide the wearer with an ability to listen to sound free from the disturbing effects of background noise. Noise cancellation headphones are used widely in commercial passenger aircraft and general aviation and are now experiencing adoption in the mainstream in a variety of consumer audio applications.

Headphones, whether passive or noise cancellation, can be designed in either a supra aural or circum aural configuration. In the case of the former, the headphone rests on top of the ear with the interface to the wearer typically being soft open-cell foam. In the case of the latter, the ear cup completely encloses the ear with the human-headphone interface typically being a foam based leatherette ear pad.

Noise cancellation headphones are also configured in circum aural or supra aural arrangements. Circum aural noise cancellation headphones, however, tend to provide a better overall noise suppression effect as the complete seal provided by the ear pad insulates the ear from the higher frequencies of sound which are more difficult to reduce by active noise cancellation techniques.

Headphones, whether passive or active noise cancellation, are typically large and comprise a headband that can either be worn on top of the head or behind the neck. Headphones can be clumsy, uncomfortable and space consuming, especially for those who travel frequently.

An alternative solution for the personal reproduction of sound is an earphone such as an "ear bud" which is placed directly in or adjacent to the auditory canal. Known earphones generally comprise one or two small audio transducers that are placed directly in or adjacent to the auditory canal. Earphones are used widely with hands-free cellular phone kits and portable audio devices such as mp3 and DVD players.

Earphones can be difficult to locate within the ear, leading to the user discomfort, and in some cases poor performance for the user. Incorrect fit can also lead to earphones falling from the user's ear.

Presently, few noise cancellation ear buds solutions exist in the marketplace. The few products that have been developed and commercialised rely on a feed forward active noise cancellation configuration.

A feed forward active noise cancellation system is relatively simple in that it relies on a reference signal to generate a control response; this reference signal being somehow related to the signal requiring control.

In the case of a feed forward earphone active noise cancellation solution, the best choice of reference signal is a measure of the ambient noise directly outside of the earphone's seal against the ear. This reference signal, obtained by way of a microphone transducer, is processed by noise cancellation electronic circuitry (filters) to generate an appropriate control response. The circuitry is designed to replicate the dynamic behaviour of the acoustic system between the reference measurement and control positions. All things being equal, the control response, once output via the earphone's speaker will effect cancellation of the noise that has infiltrated the ear canal. A feed forward controller is 'dumb' in the sense that it does not have any measure of its own performance. It relies on a prior knowledge of the disturbance (noise) and the acoustic system.

Unfortunately, in the case of a feed forward earphone active noise cancellation control configuration, the reference signal is not fully representative of the noise that actually penetrates the earphone's seal and enters the auditory canal. The maximum performance of a feed forward active noise cancellation system can be calculated mathematically by measuring the coherence between the reference signal and the sound that penetrates the ear canal. This can be significantly less than unity, especially where the ear bud does not present a tight seal around the ear canal or the acoustics of the ear canal varies from that measured to determine the control filters.

A feedback control configuration relies on an error measurement located downstream from the point of control. The error represents a logical difference between a desired outcome and the measured result.

As the control response of a feedback control configuration is directly related to its own output it is far more susceptible to an instability condition. This is especially true where the system under control is subject to change. In the context of active noise cancellation, instability manifests itself as an uncontrolled ringing. Such a condition is unpleasant and can damage the hearing organ. Instability problems have lead to very few earphones which incorporate active noise cancellation systems being successful, commercially viable, consumer products. Development of an effective active noise cancellation product requires a careful balancing of a number of system parameters.

Although some noise cancellation (e.g. less than 20 dB) can often be achieved, instability problems mean that effective noise cancellation using an earphone is very difficult without the need for a complex controller. For example, U.S. Pat. No. 4,985,925 discloses an earplug including a speaker and a microphone for use with an active noise reduction control circuit having a shunt feedback control filter. The earplug can for some audio frequencies provide effective noise cancellation, but a very complex control circuit is required. Also, despite the complex controller, active noise cancellation is poor between 1 kHz and 2 kHz, and the earplug may still have a stability problem in that frequency range.

Another constraint on a controller for present consumer earphone products is size, weight and power constraints. For example, when being used in conjunction with a portable MP3 player a controller needs to be small and light enough to be worn as a medallion, and typically needs to operate off a 1.5 to 3 volt battery power supply. Therefore the controller order, driving voltage swing and available power are very limited. This also makes it important to provide a solution that reduces the demands placed on the controller.

BRIEF SUMMARY OF THE INVENTION

It is an object of the present invention to provide an earphone for a noise cancellation system which will allow the limitations of a feed forward noise cancellation ear bud earphone to be overcome by applying feedback control methods with an acoustic configuration conducive for such an application.

Alternatively or additionally it is an object of the present invention to provide an effective means of providing active noise cancellation in an ear bud that is also stable and robust.

Alternatively or additionally it is an object of the invention to provide an improved ear bud earphone, or an improved earphone noise cancellation system, or to at least provide a useful alternative to known constructions.

Accordingly in one aspect the invention broadly consists in an earphone for an active noise reduction system, the earphone having an auricle portion adapted to be received in the auricle of a human ear, and a canal portion adapted to be received in the auditory canal of the ear, the auricle portion having a speaker and a microphone provided anteriorly of the speaker, the canal portion being rotatably mounted relative to the auricle portion such that the canal portion can be angularly adjusted relative to the auricle portion dependent on the ear geometry of a user to allow the canal portion to be received in the auditory canal and the auricle portion to be supported in the auricle.

Preferably the assembly includes a locking means which may be activated to prevent adjustment of the canal portion relative to the auricle portion.

Preferably the locking means may be selectively deactivated to allow adjustment of the canal portion relative to the auricle portion.

Preferably the canal portion is received in the entrance to the auditory canal.

Preferably the canal portion is received in the auditory canal so as to make an effective acoustic seal between the canal portion and the auditory canal.

Preferably the canal portion is mounted eccentrically relative to the auricle portion.

Alternatively, the canal portion has a central axis disposed at an angle to a central axis of the auricle portion.

Preferably the auricle portion includes an acoustic transducer for producing sound in response to an electrical signal.

Preferably the auricle portion includes a microphone. Preferably the microphone is located anteriorly of the acoustic transducer.

Preferably the canal portion includes a tubular acoustic path, and one or both of the auricle portion and the canal portion provide a cavity upstream of the tubular acoustic path such that the cavity and the tubular acoustic path form a resonator having a desired resonant characteristic.

In a further aspect the invention broadly consists in an earphone for use with the noise cancellation system, the earphone including an acoustic transducer for producing sound in response to an electrical signal, and a microphone located anteriorly of the acoustic transducer.

In a further aspect the invention broadly consists in an earphone assembly comprising a carrier which carries an acoustic transducer for producing sound in response to an electrical signal, and carries a microphone, the carrier being adapted to be retained within a suitable housing.

Preferably the housing comprises a first component having a stem dependent therefrom, and a second component which is adapted to be received in the auricle of an ear.

In a further aspect the invention broadly provides an earphone feedback noise cancellation system including an ear bud earphone having an acoustic transducer for producing sound in response to an electrical signal and a microphone, and feedback noise cancellation circuitry adapted to receive a feedback signal from the microphone and provide an appropriate signal to the acoustic transducer to in use provide noise suppression.

In a further aspect the invention broadly provides an earphone having a housing, the housing including an acoustic outlet and at least a part of the housing adjacent to the acoustic outlet being adapted to be received in an ear canal, a speaker driver provided in the housing, an acoustic path from the driver through a pipe to the acoustic outlet, and wherein the construction is such that a resonance occurs at a predetermined frequency or over a predetermined frequency range.

Preferably the resonance is a Helmholtz resonance.

Preferably a cavity is provided in the acoustic path between the driver and the pipe.

Preferably the resonance allows a phase recovery to occur.

Preferably the pipe comprises an elongate or tubular acoustic path.

Preferably the predetermined frequency is approximately 500 Hz-1 kHz.

In a further aspect the invention provides an earphone feedback noise cancellation system including an earphone as set forth in the preceding statement of invention, and feedback noise cancellation circuitry adapted to receive a feedback signal from the microphone and provide an appropriate signal to the speaker in use provide noise suppression.

Further aspect of the invention will be apparent from the following description.

DRAWING DESCRIPTION

Figure 2:
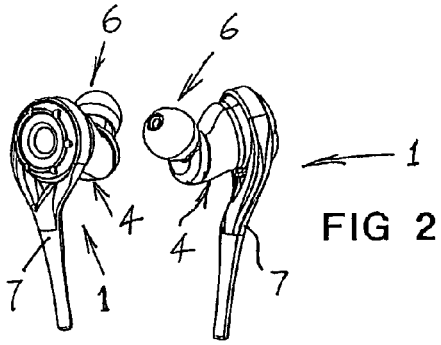
Figure 3:
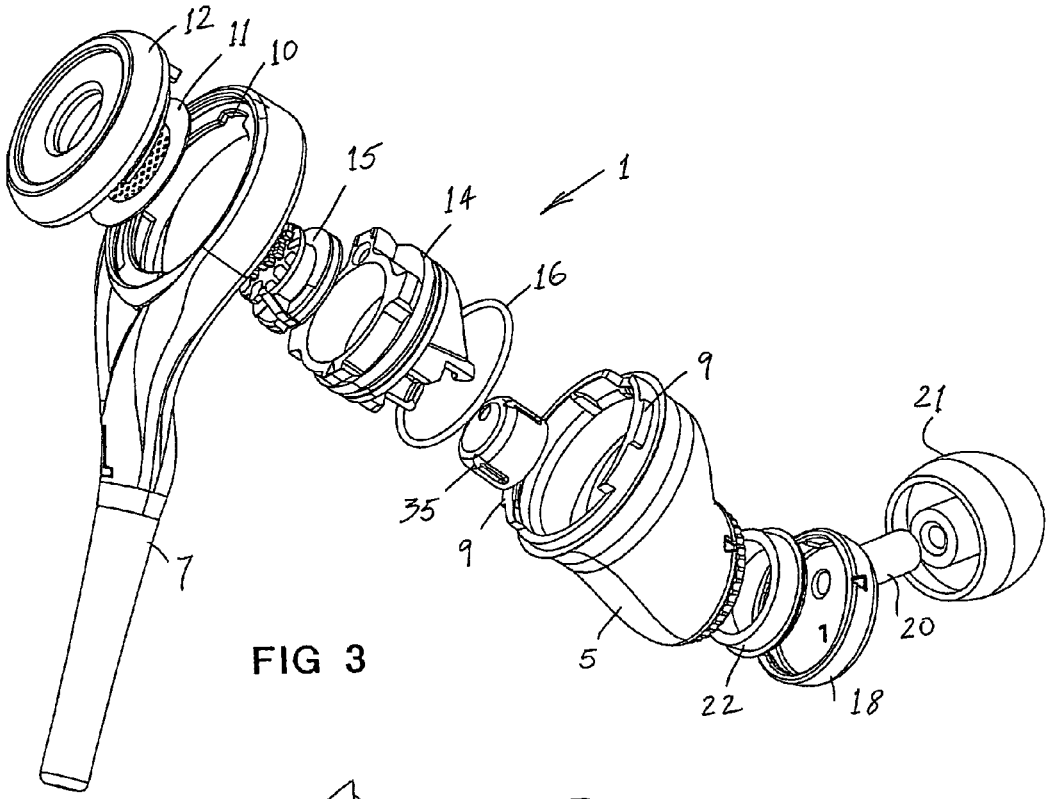
Figure 4:
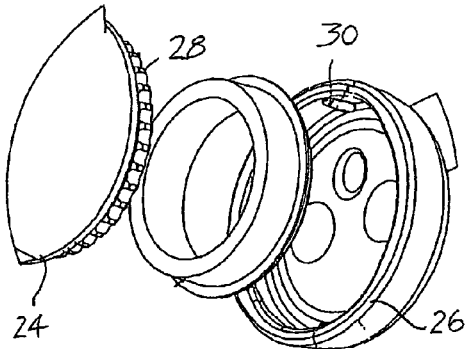
Figure 5:
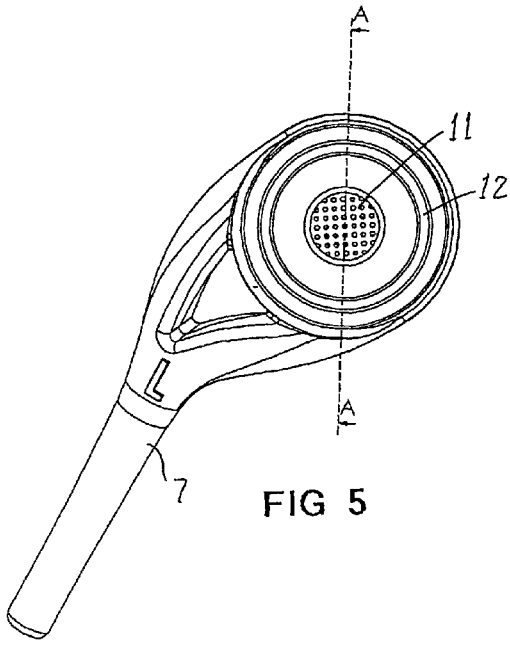
Figure 6:
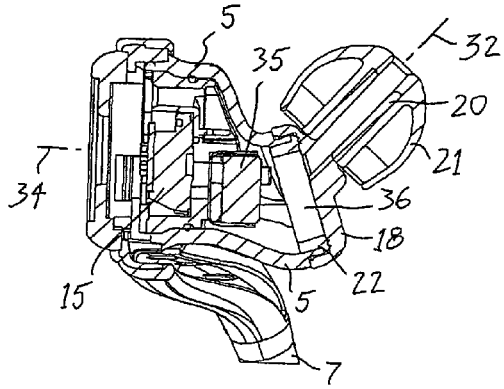
Figure 8:
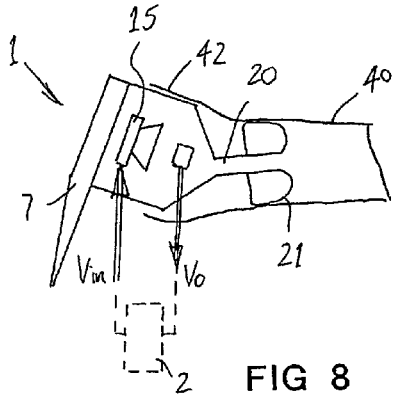
Figure 9:
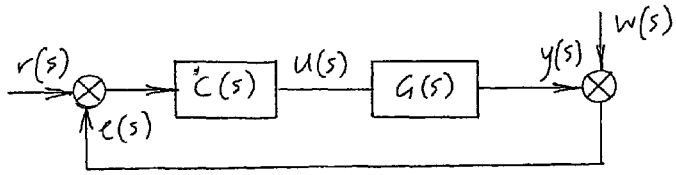
Figure 10:
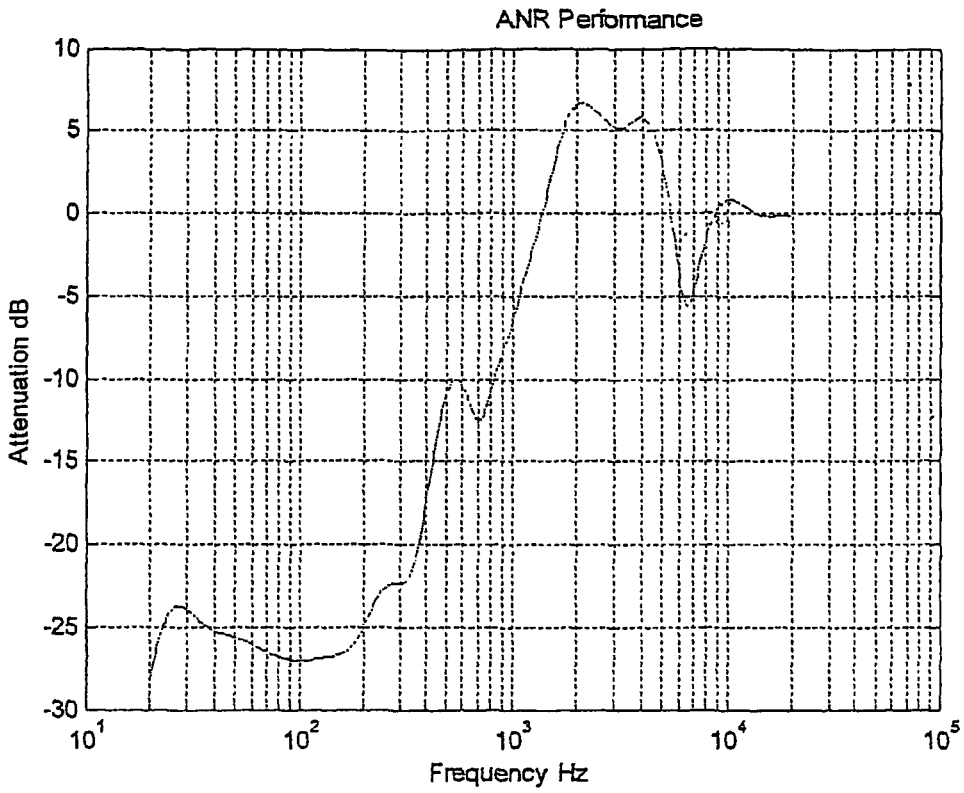

One or more embodiments of the invention will be described by way of example with reference to:

FIG. 1 which is a plan view of a feedback controlled noise cancellation system including an earphone assembly, FIG. 2 which is a perspective view of two earphone assemblies, FIG. 3 which is an exploded perspective view of one of the earphone assemblies of FIG. 2, FIG. 4 which shows the features of FIG. 3 in greater detail which support adjustable interconnection between an auricle portion of the earphone assembly and a canal portion of that assembly, FIG. 5 which is a rear elevation of an earphone according to FIG. 2, FIG. 6 which is an elevation in cross-section through line A-A of FIG. 5, FIG. 7*a* which is a block diagram representative of a cross-section of an earphone according to the invention located in an auditory canal;

FIG. 7*b* which is an illustrative plot of the transfer function gain against frequency (Hz) for the open loop acoustic plant, showing the effect of a phase recovery;

FIG. 7*c* which is an illustrative plot of phase against frequency (Hz) for the open loop acoustic plant, showing the phase recovery provided by design of the earphone;

FIG. 8 which is a diagrammatic cross-section of an earphone assembly according to the present invention within the auditory canal of a human ear, FIG. 9 which is a simplified block diagram of a feedback noise cancellation control system according to the invention, and FIG. 10 is a plot of the magnitude of the error signal (dB) against frequency (Hz).

DESCRIPTION OF PREFERRED EMBODIMENT(S)

Referring to FIG. 1, the invention includes one or more (most preferably two) ear bud earphone assemblies which are generally referenced 1, and which are electrically connected to the noise cancellation system controller which is generally referenced 2. As seen in FIG. 1, the controller takes the form of a medallion in one embodiment, but those skilled in the art will appreciate that a controller could be provided remote from the overall assembly, for example being provided in an audio player. As another example, the controller may be provided in the arm rest of the seat of a passenger vehicle, such as an aircraft.

The controller 2 may be provided in a housing which includes a power supply such as a battery. Alternatively, power could be provided from a remote source, the appropriate electrical connections being made via plug 3. In a preferred embodiment, plug 3 comprises an audio plug which is used to receive an audio signal for delivery to the earphones 1, and the noise cancellation controller 2 receives a feedback signal from a microphone (described further below) in each of the earphone assemblies so that the signal provided to the acoustic transducer in each earphone substantially cancels unwanted disturbance noise from the sound delivered to the user.

Turning to FIG. 2, the earphones (left and right) are shown. It will be seen that each earphone includes a first part generally referenced 4 which is adapted to the received in the pinna or auricle of a human ear adjacent to the entrance to the auditory canal, and which is referred to in this description as an auricle portion of the earphone assembly. A second part generally referenced 6 is adapted for location within the auditory canal of the human ear, typically at or near the entrance to the auditory canal. At a rear end of part 4, a stem 7 is provided which receives and guides the electrical cables that allow the appropriate signals to be passed between the controller 2 and the earphone 1.

FIG. 3 shows an exploded view of a preferred embodiment of the earphone assembly 1. The auricle portion which includes a housing part housing 5 is provided with a rear end 8 having one or more projections (or recesses) 9 that allow housing 5 to be connected to the stem 7. This is achieved by stem 7 having recesses (or projections) 10 which complement those on housing part 5 so that the two parts may be aligned in a desired relative angular orientation, pushed toward each other so that the projections on one part pass through or into the recesses on the other part, and then rotated relative to each other to engage the two parts. An end cap 12 can then be pushed onto the stem 7, being held in place by a friction fit and also locating a vent member 11. The ease of engagement and disengagement of the housing 5, stem 7 and end cap 12 allow earphone internal components to be easily inserted or removed, and make mass production and assembly a simple, and thus low cost, operation. Those skilled in the art will also realise that a range of the components 5, 7, 11, 12 (and others) may be provided, each having a different appearance or different aesthetics. In this way, a number of commercial products having different distinctive aesthetic or cosmetic features can be provided.

In a preferred embodiment of the invention a carrier 14 provides a sub frame for receiving an acoustic transducer such as speaker 15, which may also be referred to as a driver, and for supporting and carrying a further transducer, being a microphone 35. Carrier 14 provides a convenient and simple way to support the electromechanical components, while also allowing them to be easily removed or replaced if required. The driver 15 exhibits appropriate gain and phase characteristics in a very small diameter. This is achieved by ensuring that the volume and damping conditions are appropriate. An o-ring 16 is provided in a preferred embodiment to ensure an acoustic seal is present between the carrier and housing part 5.

The microphone 35 is also designed with particular characteristics, mainly an effective low frequency response. In a preferred embodiment the microphone is selected to ensure that the phase response of the microphone drops as close to zero as possible.

Still referring again to FIG. 3, in a preferred embodiment the canal portion comprises a housing part 18 from which extends a pipe 20 which provides an acoustic transmission path. At the distal end of pipe 20 a seal such as a grommet or "mushroom" seal 21 is provided. Seal 21 is made from a flexible resilient material, for example silicone. A coupling seal 22 assists in acoustic coupling between the housing part 5 and housing part 18 so that the parts may be moved relative to each other as described further below without compromising acoustic performance.

FIG. 4 shows further detail of the front end 24 of housing component 5, and a rear end 26 of housing component 18. The front end 24 has a plurality of teeth which form recesses 28 about a peripheral surface, and these can engage with projecting pins 30 provided on an inner surface of end 26 upon the components being pressed together in an axial direction so that the components are frictionally engaged with each other. Therefore, a user may pull housing part 18 away from housing part 5, then rotate the parts relative to each other in a plane perpendicular to the acoustic transmission path through the earphone to provide an adjustment (as will be described to the below), and then push them together again in an axial direction to lock the selected adjusted components in place. Alternatively the recesses 28 and pins 30 may be designed such that the parts may be frictionally engaged whereby they may be rotated relative to each other yet there is sufficient friction between the parts to enable them to remain in the desired orientation in use, so that a separate locking mechanism is not required.

As can be seen from FIGS. 5 and 6, the pipe 20 may be mounted eccentrically relative to the remainder of housing part 18. Therefore, rotation of the housing part 18 relative to the housing part 5 (that is to say rotation of the canal portion of the assembly relative to the auricle portion) provides an adjustment mechanism to ensure that the seal 21 of the canal portion is correctly received within the auditory canal while the auricle portion is supported in the auricle of the ear. The geometry of the human ear varies from one individual to another, but the auditory canal is typically disposed at an angle to the auricle. Therefore, allowing the position of the part 18 to be adjusted relative to part 5 is advantageous because the varying geometries can thus be accommodated. This allows a comfortable and correct fit to be achieved. A correct fit is essential for proper use to allow maximum passive and active noise cancellation.

Alternatively, or in addition to the pipe 20 being mounted eccentrically relative to the remainder of housing part 18, the central axis 32 of the canal portion may be angularly displaced relative to a central axis 34 of the auricle portion, such that the relative angle between the axes may be adjusted by rotation of the two portions.

During rotation of the part 18 relative to part 5 the integrity of the internal acoustic seal 22 is maintained so that performance is not compromised by adjustment of the housing parts.

FIG. 6 also shows a preferred location for the microphone 35, and the manner in which the microphone is supported in carrier 14. It will be seen that the microphone 35 is provided forwardly i.e. anteriorly of the driver 15 to detect any acoustic disturbances within the earphone assembly. In the embodiment shown the microphone 35 is supported in the carrier 14 so that it is directed toward the auditory canal. The acoustic path within the earphone assembly extends from the driver, past microphone 35, and on into cavity 36 formed between housing parts 5 and 18 (i.e. between the auricle portion and the canal portion of the assembly) after which it extends through pipe 20 to exit the apparatus into the auditory canal.

The earphone 1 is designed to include a resonator or oscillator which has the effect of recovering the open loop system phase characteristics to extend the bandwidth over which active noise cancellation is effected and to improve the relative stability of the closed loop. This enables an increase in feedback gain and thus the level of noise cancellation which is achieved. This allows the controller to be kept relatively simple while still achieving effective noise cancellation without instability.

The resonator may be viewed as a Helmholtz resonator, and in a preferred embodiment is designed to create a resonance at a frequency band of approximately 500 Hz-1 kHz which has the effect of recovering the phase information in order to reduce the constructive interference of the system and as a result limits the amplification of the background noise created by the system.

Referring to FIGS. 7A-7C, a Helmholtz resonator is a container of air (the cavity of the auditory canal 40 in this case) with an open neck (pipe 20). The volume of air near the open neck vibrates because of the "springiness" of the air inside. When the air is compressed in the neck, the pressure increases and the air tends to expand back to its original volume. The momentum of the air will then rarefy the air inside the body which will tend to compress it back to its original volume. That movement creates a vibration at a single frequency. The driver 15 provides the power to maintain the oscillation. The resonant frequency f is defined as follows:

$$f = \frac{c}{2\pi}\left(\frac{S}{Vl}\right)$$

l=pipe (20) length
V=volume of the container (i.e. of the auditory canal cavity)
S=cross sectional area of the pipe (20)
c=speed of sound An impedance change at the opening of the pipe 20 nearest the driver 15 is necessary to prevent the pipe otherwise appearing acoustically as an endless tube. The impedance change is achieved by having a sudden change in the diameter of the exit of the pipe 20 to the internal cavity 36 between the driver 15 and the pipe 20.

The microphone 15 is positioned near the open end of the pipe 20 in order to pick up the resonance.

As can be seen from FIGS. 7*b* and 7*c*, the resonance that begins around 500 Hz provides a phase recovery and this in turn extends the gain which assists with designing a controller that achieves improved active noise reduction performance. Loci 50 and 52 illustrate use of the resonator, and loci 51 and 53 show the effect without the resonator. IEC standard 711-1981 for the internal ear may be used to test and/or simulate earphone performance.

Turning now to FIG. 8, the earphone assembly described above is shown diagramatically in cross-section positioned within an auditory canal 40 and auricle 42. The flexible outer surfaces of the mushroom seal 21 make an effective acoustic seal with inner surfaces of the auditory canal to prevent the incursion of extraneous sound to create a closed controllable system whilst also minimising the transmission into the auditory canal of extraneous sound. Therefore there is maximum passive attenuation of acoustic disturbances which originate exteriorly of the earphone assembly.

The open loop system is defined by Vo/Vin when not closed by the controller 2. When the open loop plant is closed through the controller the closed loop system is realised.

FIG. 9 illustrates the various control parameters of the system—r(s) being the reference signal (for example an audio signal), e(s) being the error signal from the microphone, u(s) being the signal provided by the controller (represented by function C(s) in FIG. 9), y(s) being the output of the plant (i.e. the driver and acoustic path which are represented by G(s), and w(s) being an acoustic disturbance.

The control law is given by:

$$e(s)=1/(1+C(s)G(s))$$

Thus, the larger the gain, the lower the error. The control law may be implemented using known techniques as described in the prior art.

Performance of the system is seen in FIG. 10 where it can be seen that in a preferred embodiment noise rejection at low frequencies of up to 30 dB is achievable. This is highly desirable, particularly in environments such as aircraft cabins in which low frequency noise is predominant.

From the foregoing that will be seen that an earphone assembly is provided which allows a feedback noise cancellation system to be used with a simple and inexpensive controller without stability problems because the earphone is designed to acoustically achieve a phase recovery. Thus the control law utilised is of as low an order as possible, is power efficient and does not require a substantial voltage swing. The assembly has significant advantages in being adjustable to suit the geometry of a user's ear while also providing an effective acoustic seal with the auditory canal. The assembly is also simple and easy to manufacture, and is easily assembled or disassembled. The modular nature of the electromechanical transducer arrangement means that these components are easily placed within the earphone assembly, and are easily removed if required. The feedback control system that is provided allows very effective noise rejection.

Although certain examples and embodiments have been disclosed herein it will be understood that various modifications and additions that are within the scope and spirit of the invention will occur to those skilled in the art to which the invention relates. All such modifications and additions are intended to be included in the scope of the invention as if described specifically herein.

The invention claimed is:

1. An earphone for a feedback active noise cancellation system, the earphone comprising a housing having an acoustic outlet adapted to be received in the auditory canal of the ear, a speaker and a microphone provided in the housing anteriorly of the speaker, the speaker and microphone being adapted to be connected to a feedback controller to provide a close-loop active noise cancellation system, the earphone having an acoustic path from the speaker through a pipe to the acoustic outlet such that a Helmholtz resonance occurs between the pipe and the auditory canal at a predetermined frequency over a predetermined frequency range to thereby improve the stability of the closed-loop system.

2. The earphone of claim 1 wherein the resonance provides a phase recovery.

3. The earphone of claim 1 wherein the pipe comprises a tubular acoustic path.

4. The earphone of claim 1 wherein the predetermined frequency is substantially within the range 500 Hz to 1 kHz.

5. The earphone of claim 1 wherein the housing includes a sealing means to substantially acoustically seal the acoustic outlet at the entrance to the auditory canal.

6. The earphone of claim 1 wherein a cavity is provided in the acoustic path between the speaker and the pipe.

7. The earphone of claim 6 wherein the cavity provides an acoustic impedance between the speaker and the pipe.

8. The earphone of claim 1 wherein the housing comprises an auricle portion adapted to be received in the auricle of a human ear, and a canal portion adapted to be received in the auditory canal, the auricle portion holding the speaker and microphone, the canal portion being rotatably mounted relative to the auricle portion such that the canal portion can be angularly adjusted relative to the auricle portion dependent on the ear geometry of a user to allow the canal portion to be received in the auditory canal and the auricle portion to be supported in the auricle.

9. The earphone of claim 8 wherein the housing includes a sealing means to substantially acoustically seal the acoustic outlet at the entrance to the auditory canal, and wherein the canal portion includes a sealing means to make an effective acoustic seal between the canal portion and the auditory canal of a user.

10. The earphone of claim 8 wherein a cavity is provided in the acoustic path between the speaker and the pipe and wherein the cavity is provided between the auricle portion and the canal portion.

11. The earphone of claim 10 wherein the housing has a stem dependent therefrom, the stem being adapted for location externally to the ear.

12. The earphone of claim 8 including a locking means, activation of the locking means preventing adjustment of the canal portion relative to the auricle portion.

13. The earphone of claim 12 wherein deactivation of the locking means allows adjustment of the canal portion relative to the auricle portion.

14. The earphone of claim 8 wherein the canal portion is received in the entrance of the auditory canal.

15. The earphone of claim 8 wherein the canal portion is mounted eccentrically relative to the auricle portion.

16. The earphone of claim 8 wherein the canal portion has a central axis disposed at an angle to a central axis of the auricle portion.

17. The earphone of claim 1 including a carrier for carrying the speaker and the microphone, the carrier being adapted to be retained within the housing.

18. The earphone of claim 1, including feedback noise cancellation circuitry adapted to receive a feedback signal from the microphone and provide an appropriate signal to the speaker to provide active noise cancellation.

* * * * *